US010870523B2

(12) United States Patent
Neale

(10) Patent No.: US 10,870,523 B2
(45) Date of Patent: Dec. 22, 2020

(54) CORNER PROTECTOR

(71) Applicant: WestRock Container, LLC, Atlanta, GA (US)

(72) Inventor: Joseph Neale, Sanford, FL (US)

(73) Assignee: WESTROCK CONTAINER, LLC, Atlanta, GA (US)

( * ) Notice: Subject to any disclaimer, the term of this patent is extended or adjusted under 35 U.S.C. 154(b) by 271 days.

(21) Appl. No.: 16/033,634

(22) Filed: Jul. 12, 2018

(65) Prior Publication Data

US 2019/0016519 A1 Jan. 17, 2019

Related U.S. Application Data

(60) Provisional application No. 62/532,124, filed on Jul. 13, 2017.

(51) Int. Cl.

| | |
|---|---|
| ***B65D 81/05*** | (2006.01) |
| ***B65D 5/72*** | (2006.01) |
| ***B65D 5/50*** | (2006.01) |

(52) U.S. Cl.

CPC ..... *B65D 81/053* (2013.01); *B65D 5/50* (2013.01); *B65D 5/725* (2013.01); *B65D 81/057* (2013.01); *B65D 2581/052* (2013.01); *B65D 2581/053* (2013.01); *B65D 2581/055* (2013.01)

(58) Field of Classification Search

USPC ..... 206/453, 586

See application file for complete search history.

(56) References Cited

U.S. PATENT DOCUMENTS

| | | | | | |
|---|---|---|---|---|---|
| 2,896,833 | A * | 7/1959 | Markham | B65D 81/057 | 206/454 |
| 3,220,683 | A * | 11/1965 | Doll | B65D 81/056 | 248/345.1 |
| 4,134,496 | A * | 1/1979 | Smith | B65D 81/057 | 206/453 |
| 4,192,423 | A * | 3/1980 | Rekow | B65D 81/056 | 206/586 |
| 4,407,898 | A * | 10/1983 | Kato | B65D 5/5088 | 206/453 |
| 5,297,682 | A * | 3/1994 | Miltenberger | B65D 81/056 | 206/453 |
| 5,711,426 | A * | 1/1998 | Kuhn | B65D 81/057 | 206/586 |
| 7,900,910 | B2 * | 3/2011 | Horiuchi | B41J 13/0081 | 271/145 |
| 2005/0121357 | A1 * | 6/2005 | Robinson, Jr. | B65D 81/054 | 206/586 |
| 2009/0250367 | A1 * | 10/2009 | Murdoch | B65D 81/053 | 206/453 |

* cited by examiner

*Primary Examiner* — Jacob K Ackun

(74) *Attorney, Agent, or Firm* — John Swingle

(57) ABSTRACT

A corner protector having a pocket for the receipt of an object. The corner protector includes a window in communication with the pocket for the receipt of a portion of the object, and an undulated gripping member that provides a friction fit of the corner protector against the object.

10 Claims, 4 Drawing Sheets

CORNER PROTECTOR

PRIORITY CLAIM

This application claims priority under 35 U.S.C. § 119(e) to U.S. Provisional Application Ser. No. 62/532,124, filed Jul. 13, 2017, which is expressly incorporated by reference herein.

BACKGROUND

The present disclosure relates to a corner protector, and particularly to a corner protector including a pocket for the receipt of a separate object. More particularly, the present disclosure relates to a corner protector having a gripper for providing a friction fit against the object and a window that provides clearance for a portion of the object when the object is located in the pocket.

SUMMARY

According to the present disclosure, a corner protector and a method of forming the corner protector includes a blank having first through fifth panels. All of the panels overly one another when assembled.

In illustrative embodiments, a first panel overlies the second panel and the first and second panels include an aperture that forms the window which is adapted to receive a portion of the object that is received in the pocket.

In illustrative embodiments, the third panel is folded to overly the first panel, the fourth panel is folded to overly the third panel, and the fifth panel is inserted between the first panel and the third panel to secure all of the panels together. The pocket is formed between the first panel and the fifth panel. The fifth panel is undulated to form a gripper that provides a friction fit against the object inserted into the pocket.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
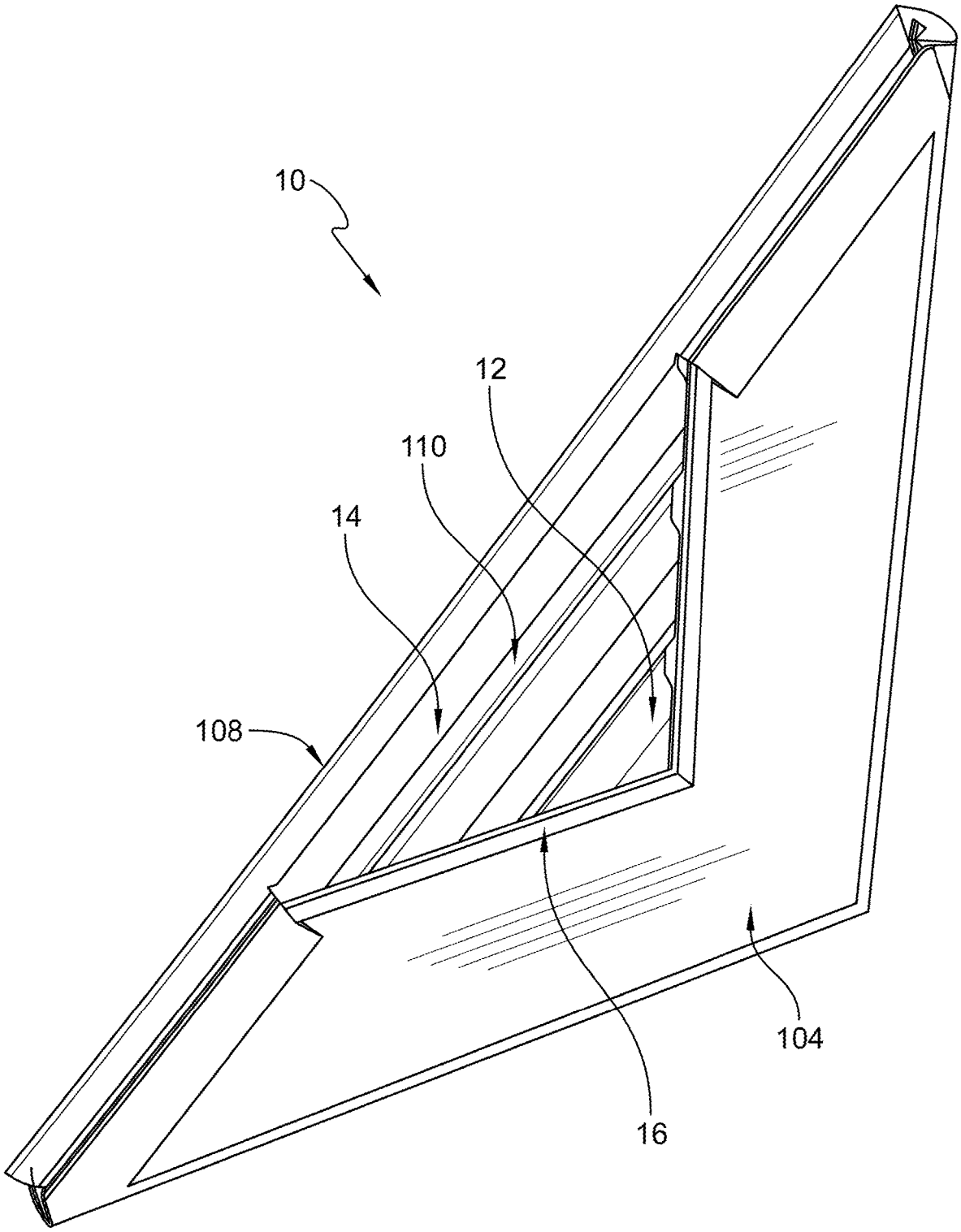
FIG. 1 is a front perspective view of an embodiment of a corner protector in accordance with the present disclosure showing that the corner protector includes a pocket, a gripper, and a window and suggesting that a corner of a separate object is received in the pocket for protection during transport.

One embodiment of a corner protector 10 in accordance with the present disclosure is shown in FIG. 1. Corner protector 10 can be used, for example, to at least partially surround corners and other pointed edges of objects, such as panels or doors, for protection during shipping. In some embodiments, corner protector 10 is used with vehicle hoods and doors. It is within the scope of the present disclosure to make corner protectors from a variety of materials including corrugated paperboard, folding carton, solid fiber, plastic sheeting, plastic corrugated, combinations thereof, or any other suitable material, and in various sizes such as B-flute or C-flute.

Corner protector 10 includes a pocket 12, a gripper 14, and a window 16 as shown in FIG. 1. Pocket 12 is configured to receive a corner of a separate object. Gripper 14 is undulated to provide a friction fit against the object. Window 16 allows for clearance of the object corner to be received in pocket 12. For example, the corner of a vehicle door is generally thinner than the remainder of the door, and window 16 allows the door corner to be inserted into pocket 12 without being blocked by other sections of the door engaging with corner protector 10. In the illustrative embodiment, corner protector 10 and window 16 are formed at about a 90 degree angle. In some embodiments, corner protector 10 and window 16 are formed at angles greater than or less than 90 degrees, and can be formed at the same or different angles from one another.

Figure 2:
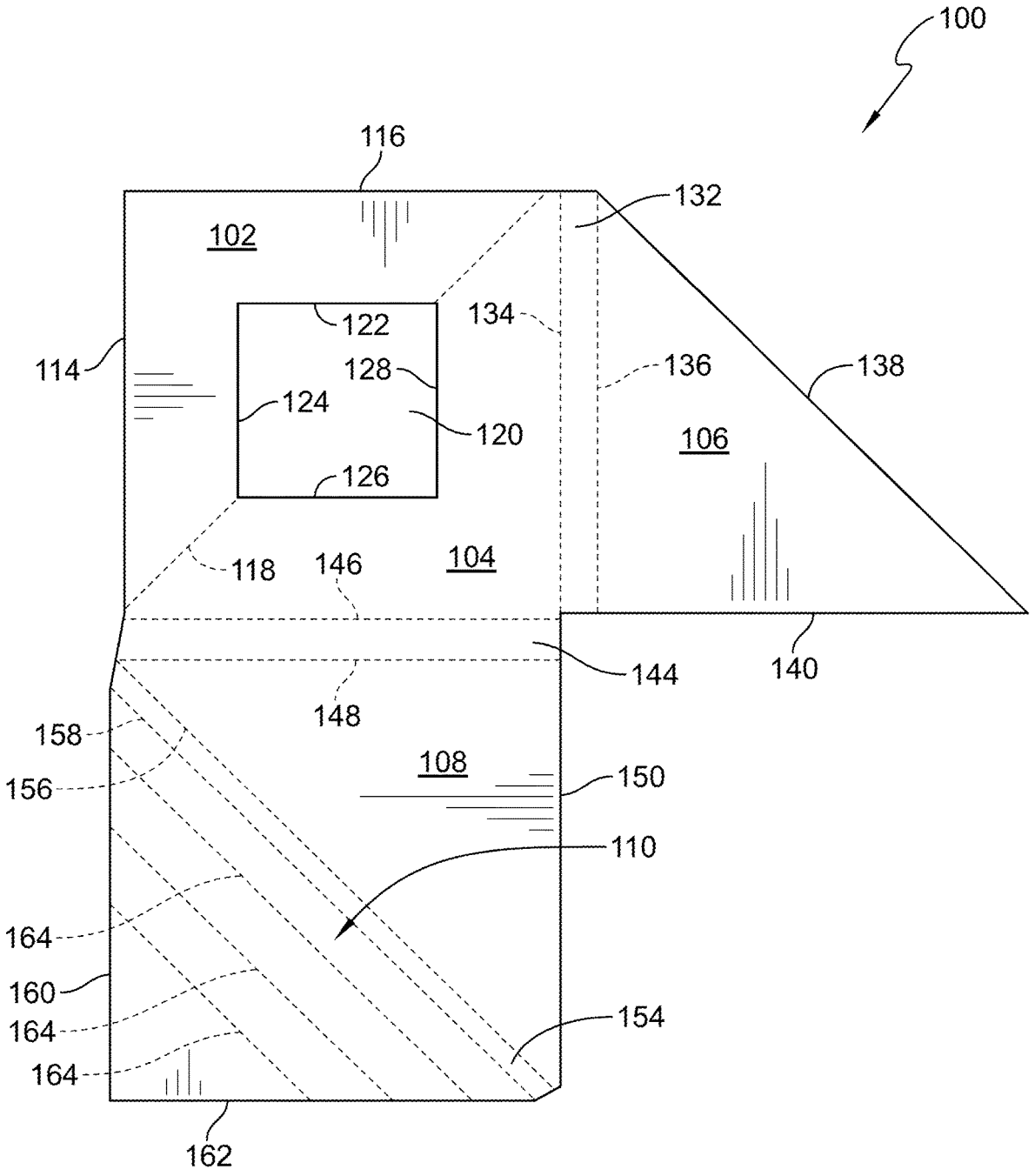
FIG. 2 is a top plan view of one embodiment of a corner-protector blank in accordance with the present disclosure used to form the corner protector of FIG. 1.

Corner protector 10 is formed from a corner-protector blank 100 shown in FIG. 2. Corner-protector blank 100 includes a plurality of panels that fold relative to one another to erect corner protector 10. As shown and described herein, when making reference to a blank of material, solid lines denote a cut line or free edge where adjacent portions of material are severed from one another and dashed lines denote a fold line where portions of material are folded relative to one another. In some examples, fold lines are scored or perforated. The panels of corner-protector blank 100 are self locking when folded such that corner protector 10 can be held together without the use of tape or adhesive. In some embodiments, tape and/or adhesive are used to bond the panels of corner-protector blank 100 together upon folding into corner protector 10.

Corner-protector blank 100, as shown in FIG. 2, includes a generally planar interior surface and a generally planar exterior surface. Corner-protector blank 100 includes a generally planar first panel 102, a generally planar second panel 104, a generally planar third panel 106, a generally planar fourth panel 108, and a generally planar fifth panel 110. Each of the panels 102, 104, 106, 108 and 110 is generally triangular shaped. First panel 102 includes a generally linear first free edge 114 and a generally linear second free edge 116. An outer end of first free edge 114 is connected to an outer end of second free edge 116. First free edge 114 and second free edge 116 are generally disposed transversely to one another at a right angle.

First panel 102 is connected to second panel 104 by and along a fold line 118. Fold line 118 extends generally linearly between an inner end of first free edge 114 and an inner end of second free edge 116. An aperture 120 is formed in and extends through first panel 102 and second panel 104. Aperture 120 is formed by a first cut edge 122 and a second cut edge 124 in first panel 102 and a third cut edge 126 and a fourth cut edge 128 in second panel 104. Each cut edge 122, 124, 126 and 128 is generally linear. Cut edges 122, 124, 126 and 128 are connected end to end in a generally rectangular or square configuration with opposing corners of the aperture being located on fold line 118. Aperture 120 is rectangular or square as shown in FIG. 2, but can be formed in other configurations if desired. Aperture 120 separates fold line 118 into two spaced apart segments respectively on each side of aperture 120.

A generally rectangular first spacer 132 connects third panel 106 to second panel 104. First spacer 132 and third panel 106 are connected to second panel 104 by and along a generally linear fold line 134. Third panel 106 is connected to first spacer 132 by and along a fold line 136. Fold line 136 is spaced apart from and generally parallel to fold line 134. Third panel 106 includes a generally linear first free edge 138 and a generally linear second free edge 140. An inner end of first free edge 138 and an inner end of second free edge 140 are located adjacent fold line 136. An outer end of first free edge 138 is connected to an outer end of second free edge 140. Second free edge 140 is disposed generally perpendicular to fold lines 134 and 136. First free edge 138 is disposed at an acute angle, such as approximately 45 degrees, with respect to second free edge 140.

Fourth panel 108 is connected to second panel 104 by a generally rectangular second spacer 144. Second spacer 144 and fourth panel 108 are connected to second panel 104 by and along a generally linear fold line 146. Fourth panel 108 is connected to second spacer 144 by and along a generally linear fold line 148. Fold lines 146 and 148 are spaced apart from one another and are generally parallel to one another. Fold lines 146 and 148 are generally transverse or perpendicular to fold lines 134 and 136. Fourth panel 108 includes a generally linear free edge 150 that is generally colinear with fold line 134, and that is generally perpendicular to second free edge 140 of third panel 106.

Fifth panel 110 is connected to fourth panel 108 by a generally rectangular third spacer 154. Fifth panel 110 and third spacer 154 are connected to fourth panel 108 by and along a generally linear fold line 156. Fifth panel 110 is connected to third spacer 154 by and along a generally linear fold line 158. Fold line 158 is spaced apart from and generally parallel to fold line 156. Fold line 156 extends generally linearly between an outer end of fold line 148 and an outer end of free edge 150 of fourth panel 108.

Fifth panel 110 includes a generally linear first free edge 160 and a generally linear second free edge 162. First free edge 160 extends between an inner end located at an inner end of fold line 158 and an outer end connected to an end of second free edge 162. Second free edge 162 extends between a first end located at an outer end of fold line 158 and a second end connected to first free edge 160. First free edge 160 and second free edge 162 are located generally transversely to one another at generally a right angle.

Fifth panel 110 includes a plurality of generally linear spaced apart and parallel fold lines 164 that extend between first free edge 160 and second free edge 162 generally parallel to fold lines 156 and 158. Fifth panel 110 is adapted to be folded along fold lines 164 such that fifth panel 110 is corrugated or undulated with alternating peaks and valleys. The undulated portion of fifth panel 110 forms gripper 24.

In order to form corner protector 10, first panel 102 of corner-protector blank 100 is folded along fold line 118 to overly second panel 104. First cut edge 122 of first panel 102 thereby overlies fourth cut edge 128 of second panel 104 and second cut edge 124 of first panel 102 overlies third cut edge 126 of second panel 104 to form window 26. Third panel 106 is then folded along fold lines 134 and 136 to overly first panel 102, such that first panel 102 is disposed between second panel 104 and third panel 106. First spacer 132 extends along and adjacent second free edge 116 of first panel 102 between the interior surface and exterior surface of first panel 102.

Fourth panel 108 is then folded along fold lines 146 and 148 to overly third panel 106 such that third panel 106 is disposed between first panel 102 and fourth panel 108. Second spacer 144 extends along and adjacent first free edge 114 of first panel 102 and second free edge 140 of third panel 106.

Fifth panel 110 is folded along fold lines 164 to form undulations, or to be corrugated. Fifth panel 110 is then folded along fold line 156 and fold line 158, and is inserted between first panel 102 and third panel 106. Third spacer 154 extends along and adjacent the first free edge 138 of third panel 106 between the interior surface and exterior surface of third panel 106. Third panel 106 is disposed between fourth panel 108 and fifth panel 110. Pocket 22 is located between fifth panel 110 and first panel 102. The connection of fifth panel 110 to fourth panel 108 by third spacer 154 along fold lines 156 and 158, and the insertion of fifth panel 110 between first panel 102 and third panel 106, locks or secures each of the panels 102, 104, 106, 108 and 110 into the folded state that forms the corner protector 10 as shown in FIG. 1, without the use of any adhesives or mechanical fasteners.

Figure 3:
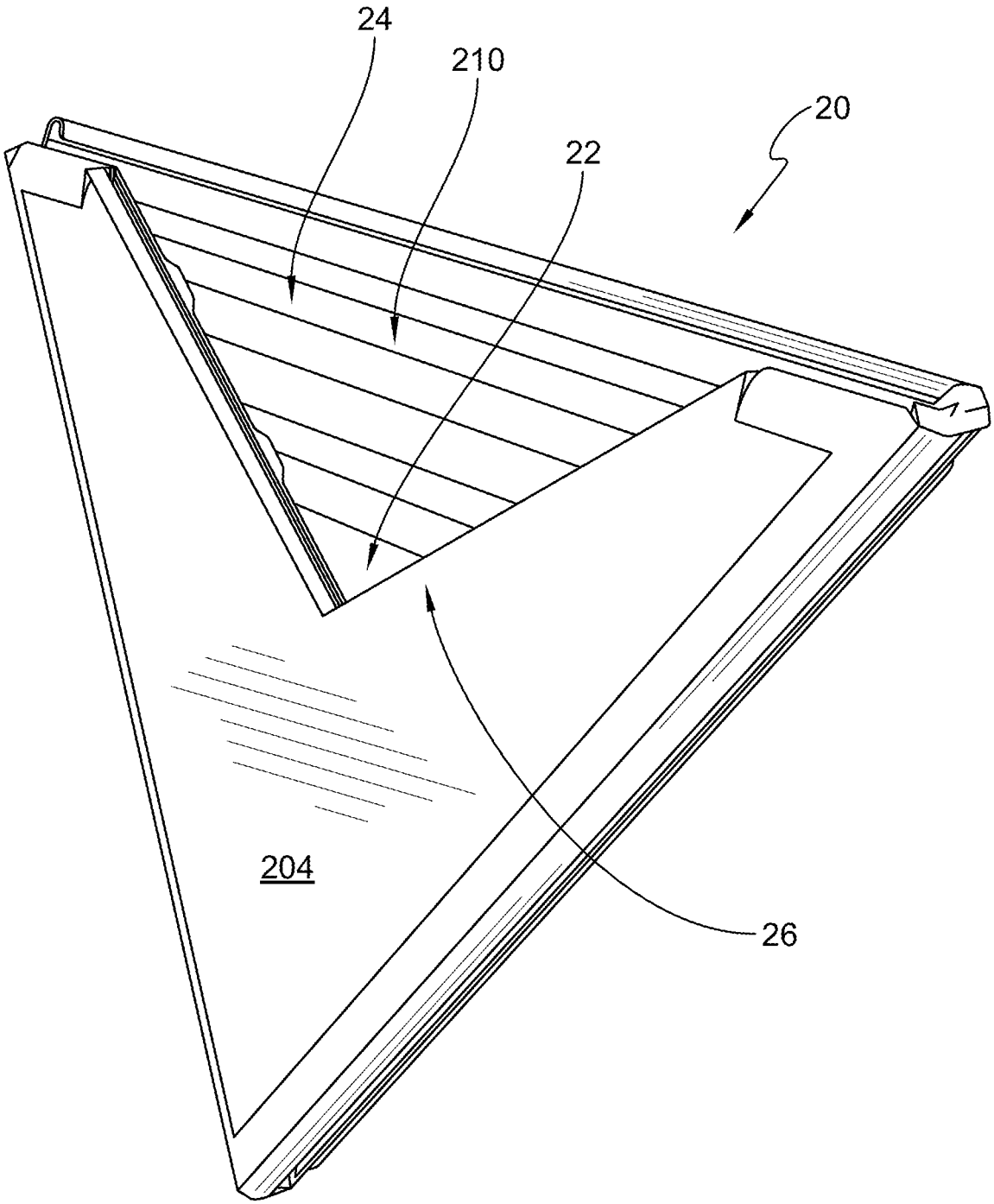
FIG. 3 is a front perspective view of another embodiment of a corner protector in accordance with the present disclosure showing that the corner protector includes a pocket, a gripper, and a window and suggesting that a corner of a separate object is received in the pocket for protection during transport.

Another embodiment of a corner protector 20 in accordance with the present disclosure is shown in FIG. 3. Corner protector 20 can be used, for example, to at least partially surround corners and other pointed edges of objects, such as panels or doors, for protection during shipping. In some embodiments, corner protector 20 is used with vehicle hoods and doors.

Corner protector 20 includes a pocket 22, a gripper 24, and a window 26 as shown in FIG. 3. Pocket 22 is configured to receive a corner of a separate object. Gripper 24 is undulated to provide a friction fit against the object. Window 26 allows for clearance of the object corner to be received in pocket 22. For example, the corner of a vehicle hood is generally thinner than the remainder of the hood, and window 26 allows the hood corner to be inserted into pocket 22 without being blocked by other sections of the hood engaging with corner protector 20. In the illustrative embodiment, corner protector 20 is formed at about a 60 degree angle and window 26 is formed at about a 100 degree angle. In some embodiments, corner protector 20 and window 26 are formed at angles greater than or less than 60 or 100 degrees, and can be formed at the same or different angles from one another.

Figure 4:
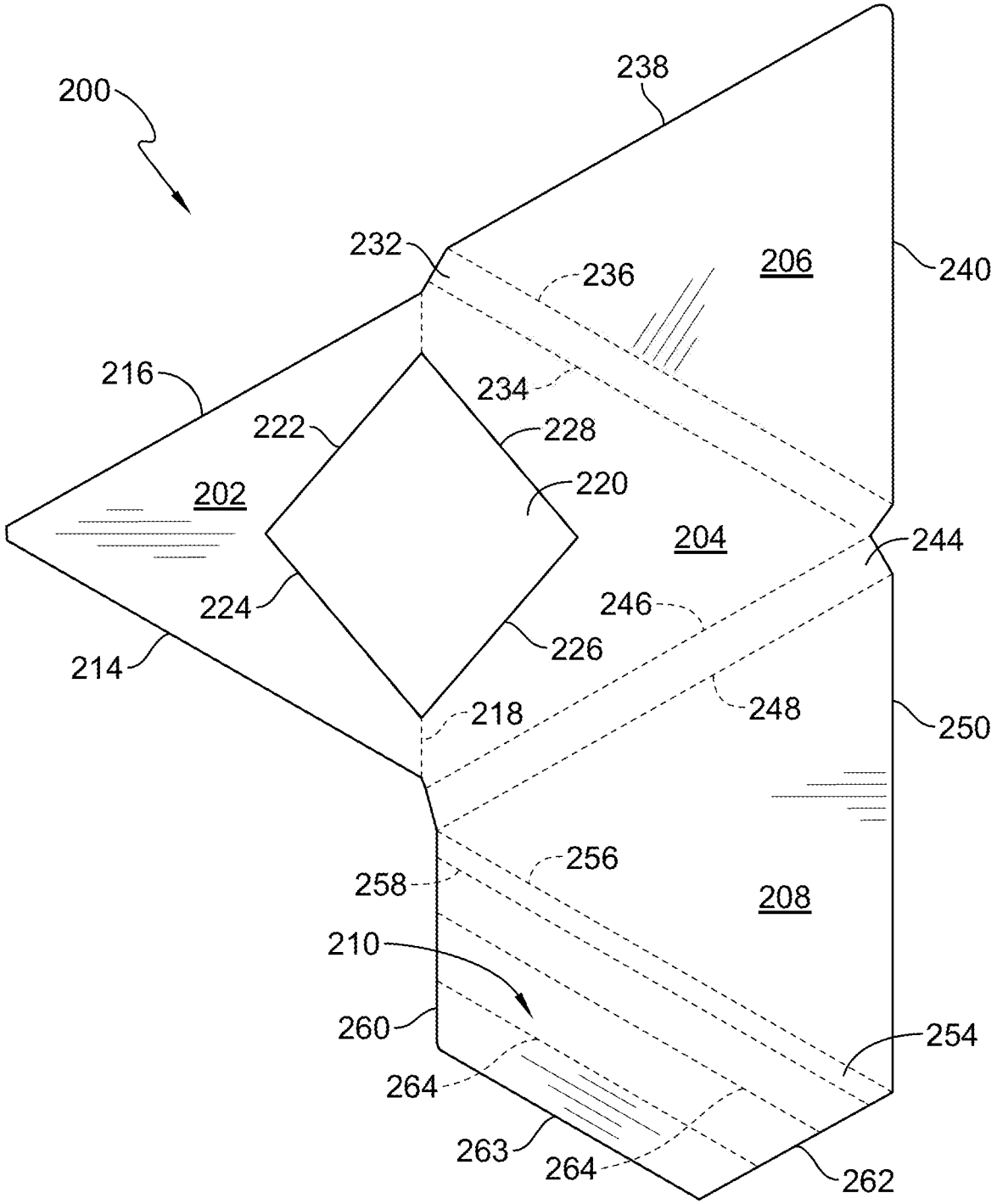
FIG. 4 is a top plan view of an embodiment of a corner-protector blank in accordance with the present disclosure used to form the corner protector of FIG. 3.

Corner protector 20 is formed from a corner-protector blank 200 shown in FIG. 4. Corner-protector blank 200 includes a plurality of panels that fold relative to one another to erect corner protector 20. The panels of corner-protector blank 200 are self locking when folded such that corner protector 20 can be held together without the use of tape or adhesive. In some embodiments, tape and/or adhesive are used to bond the panels of corner-protector blank 100 together upon folding into corner protector 10.

Corner-protector blank 200, as shown in FIG. 4, includes a generally planar interior surface and a generally planar exterior surface. Corner-protector blank 200 includes a generally planar first panel 202, a generally planar second panel 204, a generally planar third panel 206, a generally planar fourth panel 208, and a generally planar fifth panel 210. Each of the panels 202, 204, 206 and 208 is generally triangular shaped. First panel 202 includes a generally linear first free edge 214 and a generally linear second free edge 216. An outer end of first free edge 214 is connected to an outer end of second free edge 216. First free edge 214 and second free edge 216 are generally disposed to one another at approximately a sixty degree angle.

First panel 202 is connected to second panel 204 by and along a fold line 218. Fold line 218 extends generally linearly between an inner end of first free edge 214 and an inner end of second free edge 216. An aperture 220 is formed in and extends through first panel 202 and second panel 204. Aperture 220 is formed by a first cut edge 222 and a second cut edge 224 in first panel 202 and a third cut edge 226 and a fourth cut edge 228 in second panel 204. Each cut edge 222, 224, 226 and 228 is generally linear. Cut edges 222, 224, 226 and 228 are connected end to end in a generally diamond-shaped configuration with opposing corners of the aperture being located on fold line 218. Aperture 220 is diamond-shaped as shown in FIG. 4, but can be formed in other configurations if desired. Aperture 220 separates fold line 218 into two spaced apart segments respectively on each side of aperture 220.

A generally rectangular first spacer 232 connects third panel 206 to second panel 204. First spacer 232 and third panel 206 are connected to second panel 204 by and along a generally linear fold line 234. Third panel 206 is connected to first spacer 232 by and along a fold line 236. Fold line 236 is spaced apart from and generally parallel to fold line 234. Third panel 206 includes a generally linear first free edge 238 and a generally linear second free edge 240. An inner end of first free edge 238 and an inner end of second free edge 240 are located adjacent fold line 236. An outer end of first free edge 238 is connected to an outer end of second free edge 240. Second free edge 240 is disposed generally at a sixty degree angle to fold lines 234 and 236. First free edge 238 is disposed at approximately sixty degrees with respect to second free edge 240.

Fourth panel 208 is connected to second panel 204 by a generally rectangular second spacer 244. Second spacer 244 and fourth panel 208 are connected to second panel 204 by and along a generally linear fold line 246. Fourth panel 208 is connected to second spacer 244 by and along a generally linear fold line 248. Fold lines 246 and 248 are spaced apart from one another and are generally parallel to one another. Fold lines 246 and 248 are generally disposed at a sixty degree angle to fold lines 234 and 236. Fourth panel 208 includes a generally linear free edge 250 that is generally colinear with second free edge 240 of third panel 206.

Fifth panel 210 is connected to fourth panel 208 by a generally rectangular third spacer 254. Fifth panel 210 and third spacer 254 are connected to fourth panel 208 by and along a generally linear fold line 256. Fifth panel 210 is connected to third spacer 254 by and along a generally linear fold line 258. Fold line 258 is spaced apart from and generally parallel to fold line 256. Fold line 256 extends generally linearly between an outer end of fold line 248 and an outer end of free edge 250 of fourth panel 208.

Fifth panel 210 includes a generally linear first free edge 260, a generally linear second free edge 262, and a generally linear third free edge 263. First free edge 260 extends between an inner end located at an inner end of fold line 258 and an outer end connected to a first end of third free edge 263. Second free edge 262 extends between a first end located at an outer end of fold line 258 and a second end connected to a second end of third free edge 263. First free edge 260 and second free edge 262 are located generally at a sixty degree angle to one another. Third free edge 263 extends between the outer ends of first and second free edges 260 and 264 and is generally parallel with fold lines 256 and 258.

Fifth panel 210 includes a plurality of generally linear spaced apart and parallel fold lines 264 that extend between first free edge 260 and second free edge 262 generally parallel to fold lines 256 and 258. Fifth panel 210 is adapted to be folded along fold lines 264 such that fifth panel 210 is corrugated or undulated with alternating peaks and valleys. The undulated portion of fifth panel 210 forms gripper 24.

In order to form corner protector 10, first panel 202 of corner-protector blank 200 is folded along fold line 218 to overly second panel 204. First cut edge 222 of first panel 202 thereby overlies fourth cut edge 228 of second panel 204 and second cut edge 224 of first panel 202 overlies third cut edge 226 of second panel 204 to form window 26. Third panel 206 is then folded along fold lines 234 and 236 to overly first panel 202, such that first panel 202 is disposed between second panel 204 and third panel 206. First spacer 232 extends along and adjacent second free edge 216 of first panel 202 between the interior surface and exterior surface of first panel 202.

Fourth panel 208 is then folded along fold lines 246 and 248 to overly third panel 206 such that third panel 206 is disposed between first panel 202 and fourth panel 208. Second spacer 244 extends along and adjacent first free edge 214 of first panel 202 and second free edge 240 of third panel 206.

Fifth panel 210 is folded along fold lines 264 to form undulation, or to be corrugated. Fifth panel 210 is then folded along fold line 256 and fold line 258, and is inserted between first panel 202 and third panel 206. Third spacer 254 extends along and adjacent the first free edge 238 of third panel 206 between the interior surface and exterior surface of third panel 206. Third panel 206 is disposed between fourth panel 208 and fifth panel 110. Pocket 22 is located between fifth panel 210 and first panel 202. The connection of fifth panel 210 to fourth panel 208 by third spacer 254 along fold lines 256 and 258, and the insertion of fifth panel 210 between first panel 202 and third panel 206, locks or secures each of the panels 202, 204, 206, 208 and 210 into the folded state that forms the corner protector 20 as shown in FIG. 3, without the use of any adhesives or mechanical fasteners.

While corner protectors 10 and 20 are shown as triangular, other suitable shapes are contemplated by the present disclosure, including, but not limited to, square, circular, or another geometric or non-geometric shape.

The invention claimed is:

1. A corner protector comprising:

a first panel overlying a second panel, the first panel connected to the second panel along a first fold line;

a third panel overlying the first panel, the third panel connected to the second panel along a second fold line;

a fourth panel overlying the third panel, the fourth panel connected to the second panel along a third fold line;

a fifth panel located between the third panel and the first panel, the fifth panel connected to the fourth panel along a fourth fold line, the third panel being located between the fourth panel and the fifth panel; and a pocket located between the first panel and the fifth panel for removably receiving an object.

2. The corner protector of claim 1, including a window formed in the first panel and the second panel, the window overlying the fifth panel.

3. The corner protector of claim 1, wherein the connection of the fifth panel to the fourth panel secures each of the panels in their respective positions relative to one another.

4. The corner protector of claim 1, wherein the fifth panel comprises a gripper for providing a friction grip on the object that is inserted in the pocket.

5. The corner protector of claim 4, wherein the gripper comprises an undulating portion of the fifth panel.

6. The corner protector of claim 1, wherein each of the panels is generally triangular.

7. The corner protector of claim 1, wherein the first panel includes one or more external free edges and one or more internal edges, and the second panel includes one or more internal edges, the internal edges of the first and second panels forming the window.

8. The corner protector of claim 1, including a first spacer connecting the third panel to the second panel along the second fold line, the third panel connected to the first spacer along a fifth fold line.

9. The corner connector of claim 8, including a second spacer connecting the fourth panel to the second panel along the third fold line, the fourth panel connected to the second spacer along a sixth fold line.

10. The corner protector of claim 9, including a third spacer connecting the fifth panel to the fourth panel along the fourth fold line, the fifth panel connected to the third spacer along a seventh fold line.

* * * * *